US008281966B2

(12) United States Patent
Rodgers

(10) Patent No.: US 8,281,966 B2
(45) Date of Patent: Oct. 9, 2012

(54) BRACELET FASTENING DEVICE

(76) Inventor: Richard L. Rodgers, Morro Bay, CA (US)

( * ) Notice: Subject to any disclaimer, the term of this patent is extended or adjusted under 35 U.S.C. 154(b) by 259 days.

(21) Appl. No.: 12/657,500

(22) Filed: Jan. 22, 2010

(65) Prior Publication Data

US 2011/0180573 A1 Jul. 28, 2011

(51) Int. Cl.
*A47G 25/80* (2006.01)

(52) U.S. Cl. ..... 223/111

(58) Field of Classification Search ..... 223/111, 223/1; 294/2, 3, 3.6, 24
See application file for complete search history.

(56) References Cited

U.S. PATENT DOCUMENTS

| | | | | | |
|---|---|---|---|---|---|
| 1,765,076 | A * | 6/1930 | Jung | 135/65 |
| 2,867,880 | A * | 1/1959 | O'Hanlon | 294/3.6 |
| 2,926,875 | A * | 3/1960 | Hoye | 248/121 |
| 3,348,870 | A * | 10/1967 | Zern | 294/3.6 |
| 5,709,327 | A * | 1/1998 | LaMacchia et al. | 223/111 |
| 5,855,401 | A * | 1/1999 | Papernik | 294/2 |
| 6,032,996 | A * | 3/2000 | Kogen | 294/2 |
| 6,048,073 | A * | 4/2000 | Shiao | 362/120 |
| 6,112,958 | A * | 9/2000 | LaMacchia et al. | 223/111 |
| 7,213,292 | B1 * | 5/2007 | Tucker | 15/144.1 |
| 7,712,643 | B2 * | 5/2010 | Papernik | 223/111 |
| 7,784,383 | B2 * | 8/2010 | Salva et al. | 81/302 |
| 2008/0072923 | A1 * | 3/2008 | Tropeano | 132/275 |
| 2009/0031503 | A1 * | 2/2009 | Chase et al. | 7/167 |

* cited by examiner

*Primary Examiner* — Shelley Self
*Assistant Examiner* — Andrew Sutton

(57) ABSTRACT

A bracelet fastening device with a spring biased clasp gripping member, a bendable metal rod, a holding member, a sliding member, a spring post, and a resilient rod covering member. The holding member is ball shaped at one end and slidably engages with the sliding member and attached rod. The clasp gripping member is constructed like a standard alligator clip and is fixed to the opposite end of the bendable metal rod. The spring post is located within the sliding member and can engage one of a plurality of recesses inside the holding member so that the user can adjust the overall length of the device. The bendable metal rod is covered by the resilient rod covering. The rod and covering can be bent so that the clasp gripping member is in close proximity to the clasp being fastened.

2 Claims, 6 Drawing Sheets

BRACELET FASTENING DEVICE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of jewelry tools and more specifically to a bracelet fastening device.

Bracelets are generally circular in shape and fit around a person's wrist. They have been worn by people around the world for thousands of years. Many bracelets are flexible, being made of chain link or other string like material such as leather or flexible polymer. Many bracelets include a clasp portion where a loop located on one end of the bracelet chain is engaged with a clasp located on the opposite end of the bracelet chain. Attaching such a bracelet requires a level of dexterity that some people may find difficult, especially the very young and the very old or those with physical infirmities such as arthritis.

To help a person attach the loop end of a bracelet to the clasp end it would be helpful to have a tool that allows the hand that the bracelet is being attached to, be able to hold the loop end of the bracelet while the person uses the other hand to manipulate the clasp end to attach to the loop end. Ralph LaMacchia in his U.S. Pat. No. 6,112,958 has proposed such a device. It includes a gripping portion constructed in a similar way to a standard alligator clip, which is fastened to an elongate handle. The user holds onto the handle and uses the alligator clip to hold the loop end of a bracelet while the user can hold the clasp end with her other hand and attach it to the loop end.

However, while the LaMacchia device may be useful, there are significant deficiencies in the design. First, the rigid nature of the elongate handle makes it difficult for the alligator clip to end up in dose proximity to the user's wrist, making attachment more awkward. Second, the overall length of the handle is non-adjustable making it difficult to comfortably fit a variety of hand sizes. Third, the teeth of the alligator clip are hard and may harm a delicate bracelet. Fourth, the shape of the holding portion of the elongate handle is not an ideal shape for maintaining maximum control of the device. Finally, there is no provision for removing and replacing the alligator clip portion with a smaller or larger clip depending on the size of the bracelet clasp being fastened.

BRIEF SUMMARY OF THE INVENTION

The primary object of the invention is to provide a bracelet fastening device that helps a person fasten the clasp of a bracelet with one hand.

Another object of the invention is to provide a bracelet fastening device that can be adjusted in relation to a person's hand size.

Another object of the invention is to provide a bracelet fastening device that can be adjusted to have the fastening member of the device set in the ideal location.

A further object of the invention is to provide a bracelet fastening device that includes a way to attach different sized gripping members to the device.

Yet another object of the invention is to provide a bracelet fastening device whose gripping members includes rubber tips to protect the bracelet during the fastening process.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed bracelet fastening device comprising: a spring biased clasp gripping member, a bendable metal rod, a holding member, a sliding member, a spring post, and a resilient rod covering member, said clasp gripping member operating like a standard alligator clip and formed of a lower gripping portion pinned to a spring biased pivoting upper gripping portion, said upper gripping portion terminating at one end in a gripping jaw and at the opposite end in a thumb pressing portion, said lower gripping portion of said clasp gripping member terminating in a lower gripping jaw at one end and at in a rod receiving receptacle at the opposite end, said sliding member being square in cross section and elongate and including a relieved area that accepts said outwardly biased spring post, said sliding member also having a rod receiving receptacle at one end, said holding member having a ball shape at one end and tapering to a cylindrical portion at the opposite end, said cylindrical portion of said holding member having an inner wall that slidably engages said sliding member, said inside wall including a plurality of spring post retaining depressions arrayed in a linear orientation, said metal rod attaching at one end into said rod receiving portion of said lower gripping portion and at the opposite end to said rod receiving portion of said sliding member, said resilient rod covering member encasing said bendable rod, so that a user can slide said holding member over said sliding member to adjust the overall length of said bracelet fastening device and can also bend said rod portion and said resilient rod covering member to cause said clasp gripping member to be in close proximity to the clasp of a bracelet to be fastened around the user's wrist.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
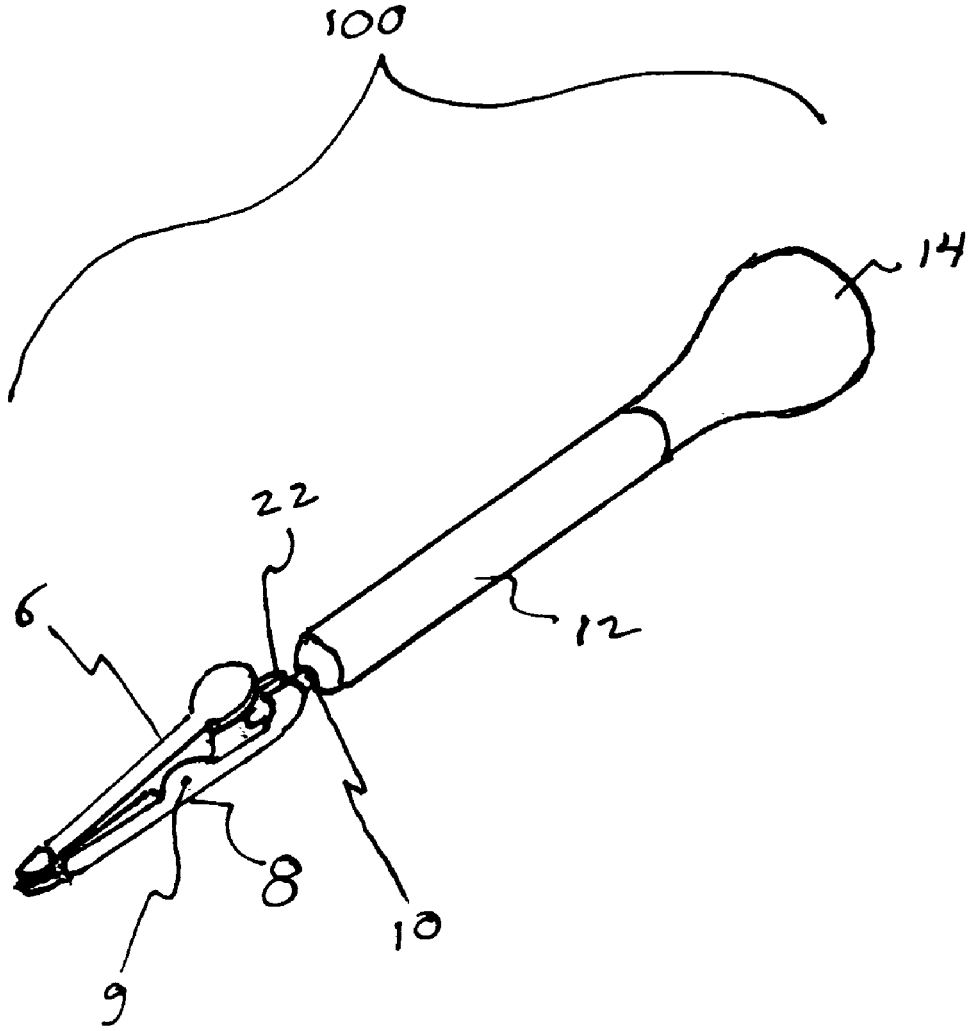
FIG. 1 is a perspective view of the invention in the straight position.
Figure 6:
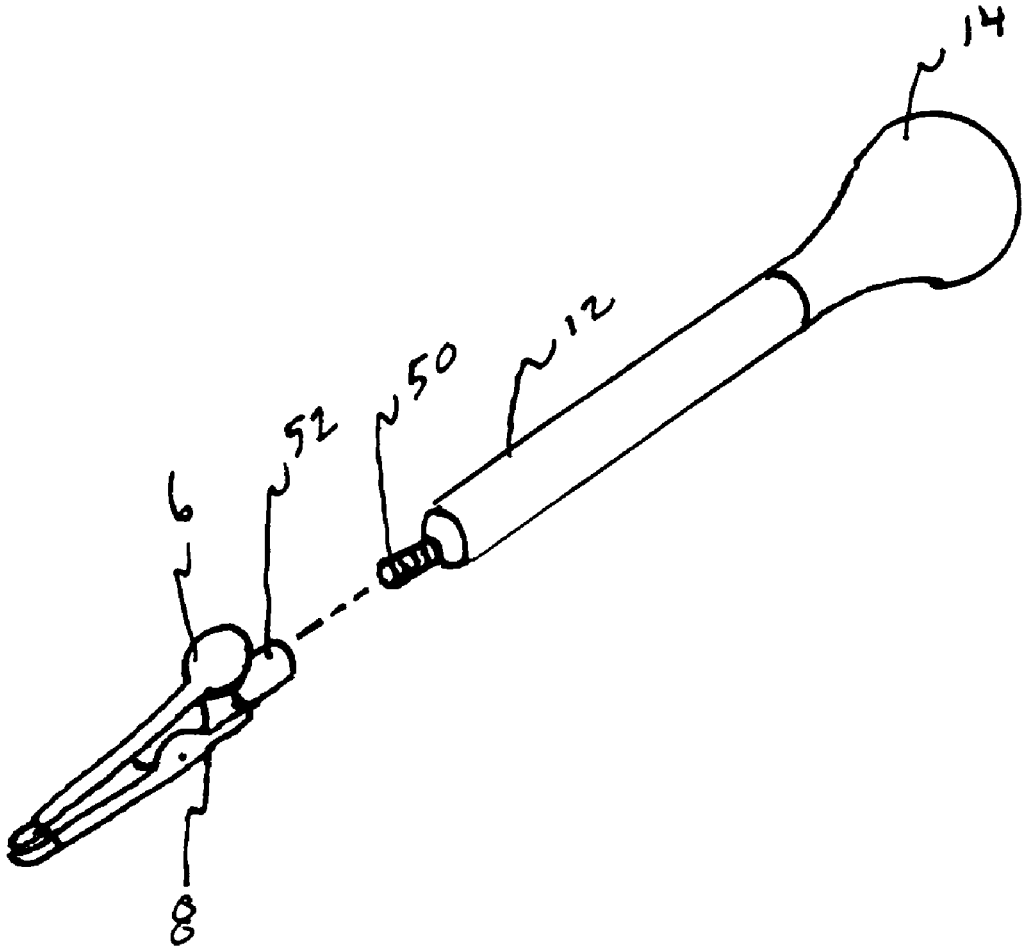
FIG. 6 is an exploded perspective view showing the removable and replaceable gripping member.

Referring now to FIG. 1 we see a perspective view of the bracelet attachment device of the present invention 100. This view shows a ball shaped portion 14 designed to comfortably fit in the palm of a user's hand. For purposes of description, this portion 14 will be called a holding member or holder. The holding member 14 terminates in a cylindrical portion that abuts with a resilient rod covering 12. A rod 10 extends from the holder 14 to the lower grip member 8 of a standard alligator type gripping device comprised of an upper grip member 6 and a lower grip member 8 pinned together by attachment pin 9. In the embodiment shown, lower grip member 8 includes a barrel type crimp on connection to rod 10. However, in an alternate embodiment shown in FIG. 6, the lower grip member 8 includes a threaded socket 52 that accepts the mating threads 50 at the end of rod 10. In this way, the user can remove and replace the alligator clip assembly allowing her to use a small alligator grip device for use with delicate small bracelets having small clasp assemblies and a larger alligator grip device for bracelets having larger clasp assemblies. Of course, other standard attachment means, such as a magnetic means can be used to fasten the lower grip member 8 to the end of rod 10.

Figure 2:
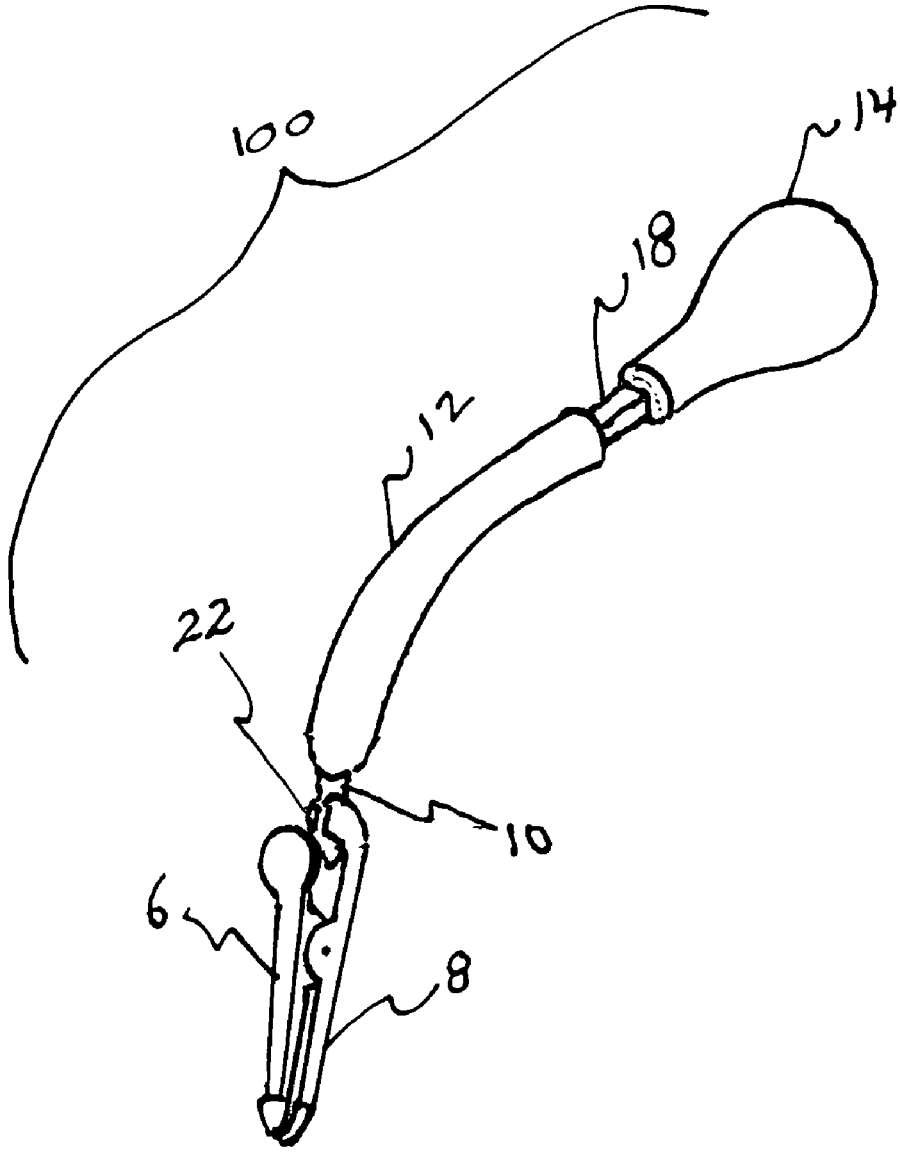
FIG. 2 is a perspective view of the invention in the curved position.
Figure 4:
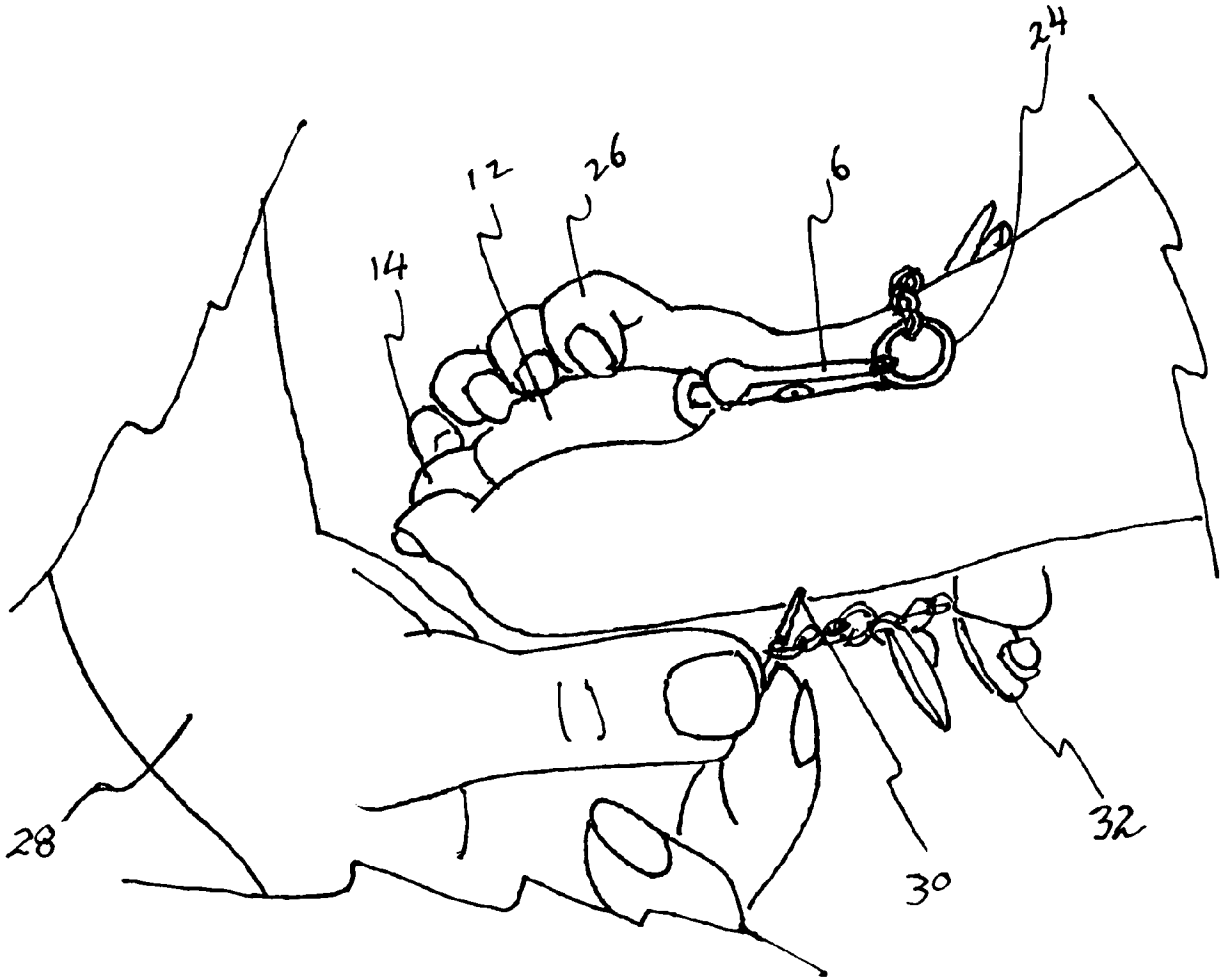
FIG. 4 is a perspective view of a person starting to attach a bracelet with the present invention.
Figure 5:
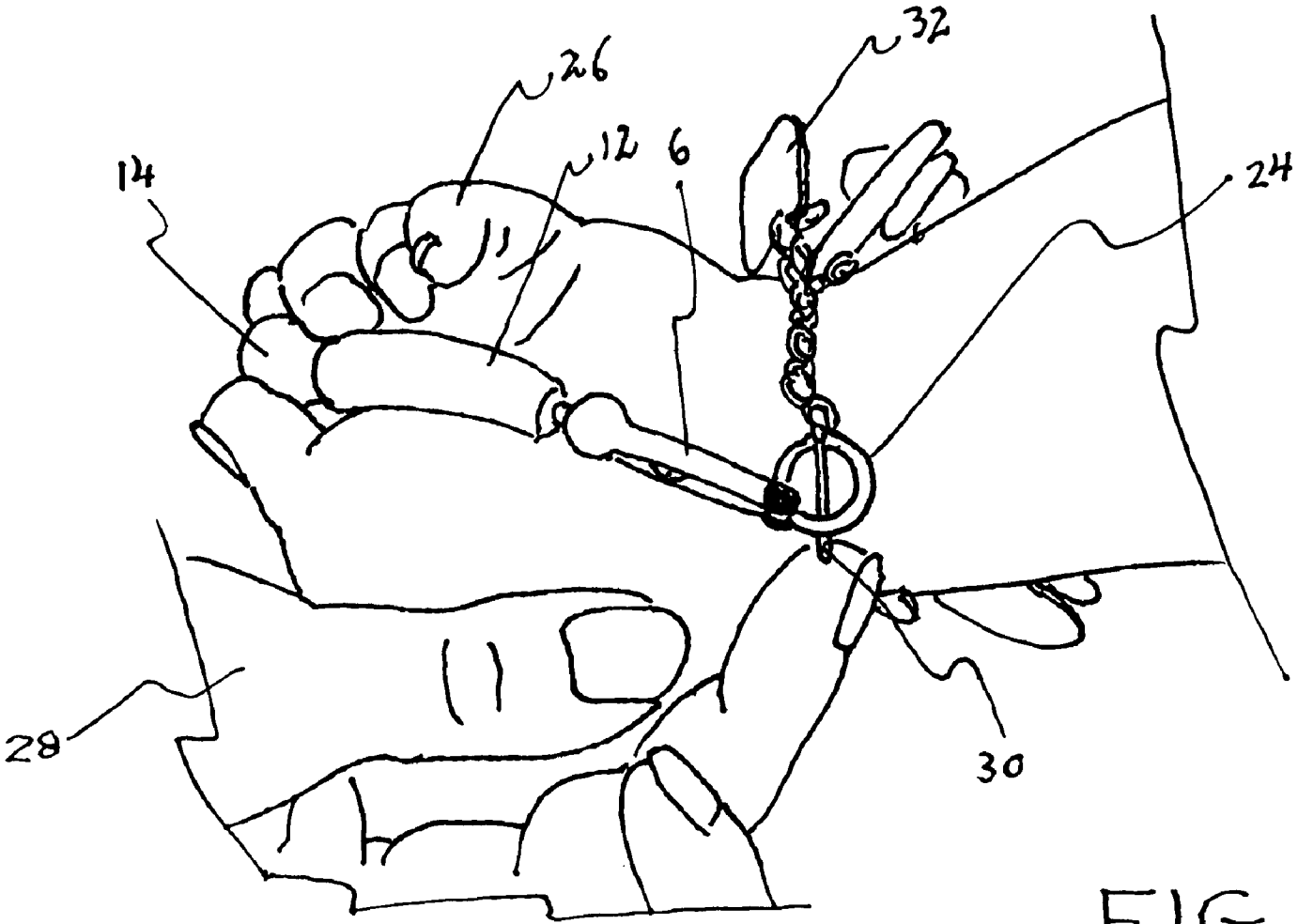
FIG. 5 is a perspective view of a person ending a bracelet attaching activity using the present invention.

FIG. 2 shows a perspective view of the invention 100 in a bent position. The bent condition is possible because the rod 10 is made of malleable material such as eight gauge 1100 series aluminum wire. This type of alloy is annealed so that it can be bent and then stay in place after the bend, and can then be re-bent to a new position numerous times without fatigue or fracture. In this way, the user can position the alligator grip device in perfect proximity to the bracelet clasp being held against the user's wrist as shown in FIGS. 4 and 5 where a user is in the first stage and final stage respectively of attachment. The ball shaped nature of the holding member 14 allows for maximum control by the user's hand 26. In an alternated embodiment, the rod 10 can be a rigid rod that terminates in a ball joint that is attached to the end of lower grip portion 8 so that only the grip portions 6, 8 are moved toward the wrist for easy bracelet fastening, rather than bending a malleable rod 10. Additionally, a standard swing away magnifier member may be added to the end of rod 10 so that the magnifying lens can be positioned directly above the tips of the grip portions 6, 8 and the clasp that is being held. However, the concept of a swing away magnifying lens placed over the tip of a tool is in the public domain.

The overall advantage of the device 100 is that the user can hold the loop 24 portion of the clasp with the device 100 while leaving the other hand 28 free to attach the secondary clasp member 30 of the bracelet 32 to the loop member 24 or any other standard primary clasp mechanism.

Figure 3:
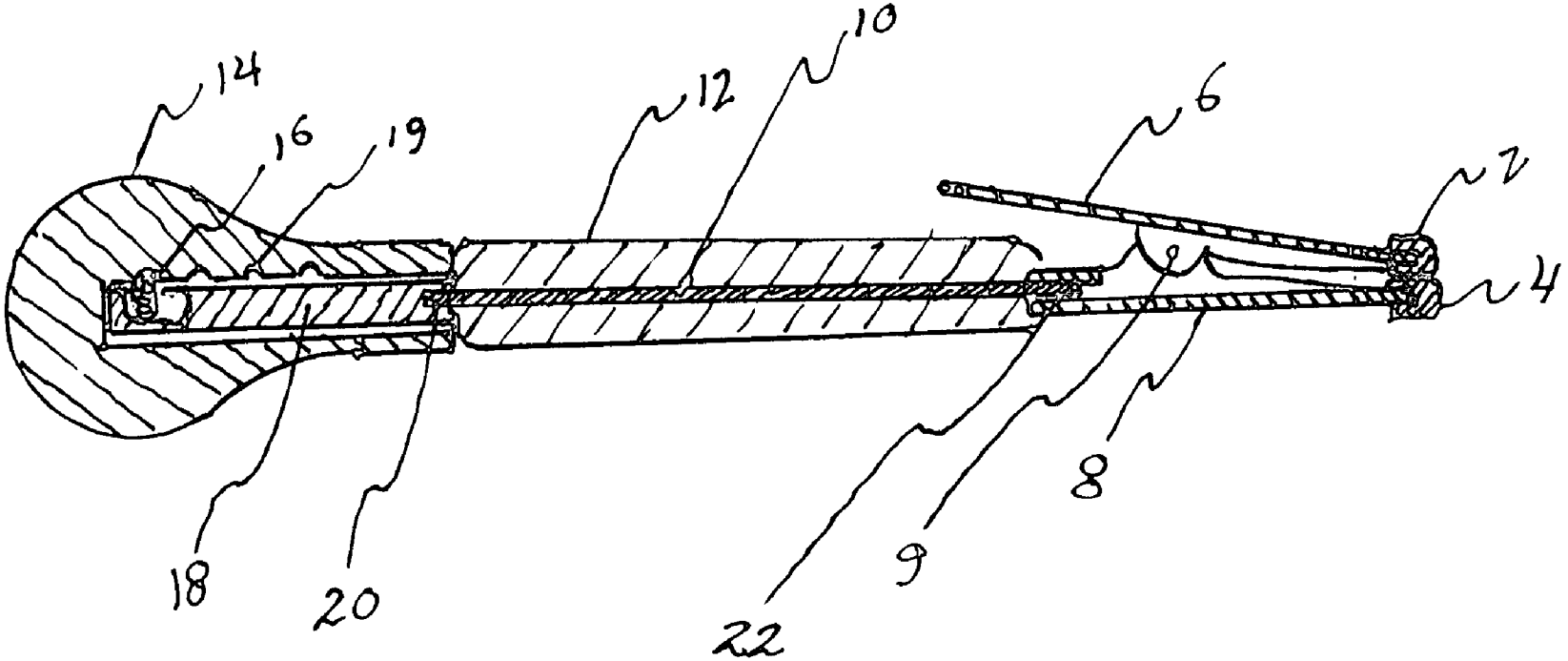
FIG. 3 is a side section view of the invention.

FIG. 3 is a side section view of the invention 100. Within ball shaped holder member 14 can be seen a central hollowed space where a sliding member 18 resides. The sliding member 18 includes a spring post 16 that can removably engage with one of the depressions 19 that are linearly arrayed on the inside wall of the hollowed area of holding member 14. In this way, the user can extend the sliding member 18 to adjust the overall length of the device 100 depending on the size of the user's hand. The sliding member 18 has a square cross section so that it can not rotate while in use. Of course any other keyed cross sectional shape will work in the present sliding member 18 design. An example of the device 100 with the slider 18 in the extended position can be seen in FIG. 2.

Continuing with the description of FIG. 3, Resilient rod cover 12 can be seen surrounding rod 10 the cover 12 can be made of rubber or other resilient material such as thermoplastic elastomer. The upper 6 and lower 8 gripping members are pinned by pivot pin 9. The gripping members are spring biased as is known in standard alligator clip design. The gripping members 6, 8 include rubber or rubber-like tips 2, 4 so that the gripping members 6, 8, do not mar or scratch the delicate finish of a bracelet clasp.

In the above described and illustrated manner, the present invention 100 helps a user attach or remove a bracelet in a novel and useful manner.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A bracelet fastening device comprising:

a spring biased clasp gripping member; a bendable metal rod; a holding member; a sliding member; a spring post; and a resilient rod covering member;

said clasp gripping member formed of a lower gripping portion pinned to a spring biased pivoting upper gripping portion forming a standard alligator clip assembly;

said upper gripping portion terminating at one end in an upper gripping jaw and at the opposite end in a thumb pressing portion;

said lower gripping portion of said clasp gripping member terminating at one end in a lower gripping jaw and at the opposite end in a rod receiving receptacle;

said sliding member being square in cross section and elongate and including a relieved area that accepts said spring post;

said sliding member having a rod receiving receptacle at one end;

said holding member having a ball shape at one end and tapering to a cylindrical portion at the opposite end;

said cylindrical portion of said holding member having an inner wall that slidably engages said sliding member;

said inner wall including a plurality of spring post retaining depressions arrayed in a linear orientation;

said bendable metal rod attaching at one end into said rod receiving receptacle of said lower gripping portion and at the opposite end to said rod receiving receptacle of said sliding member;

said resilient rod covering member encasing said bendable metal rod; so that a user can slide said holding member along said sliding member to adjust the overall length of said bracelet fastening device and can also bend said bendable metal rod to cause said clasp gripping member to be in close proximity to the clasp of a bracelet to be fastened around the user's wrist.

2. A bracelet fastening device as claimed in claim 1 further comprising rubber tips that encase the front portion of each the upper and lower gripping jaws.

* * * * *